United States Patent [19]

Bradley

[11] 4,262,952

[45] Apr. 21, 1981

[54] LIFTING TONG TOGGLE LOCK

[75] Inventor: Harvey Bradley, East Prospect, Pa.

[73] Assignee: Bradley Lifting Corp., York, Pa.

[21] Appl. No.: 106,491

[22] Filed: Dec. 26, 1979

[51] Int. Cl.[3] ..... B66C 1/42

[52] U.S. Cl. ..... 294/116; 294/118

[58] Field of Search ..... 294/116, 118, 115, 104, 294/103 R, 106, 67 BB, 67 BC

[56] References Cited

U.S. PATENT DOCUMENTS

| | | | |
|---|---|---|---|
| 937,115 | 10/1909 | Douglos et al. | 294/115 |
| 1,472,081 | 10/1923 | Mercer | 294/103 R |
| 1,492,999 | 5/1924 | Mercer | 294/103 R |
| 1,506,827 | 9/1924 | Gellert | 294/103 R |
| 1,839,389 | 1/1932 | Heppenstall | 294/110 R |
| 1,851,923 | 3/1932 | McQuigg | 294/115 |
| 2,803,489 | 8/1957 | Zito et al. | 294/103 R |

FOREIGN PATENT DOCUMENTS

| | | |
|---|---|---|
| 25407 | 10/1918 | Denmark . |
| 790821 | 11/1935 | France . |
| 1230272 | 9/1960 | France . |
| 709438 | 5/1954 | United Kingdom . |

*Primary Examiner*—James B. Marbert

*Attorney, Agent, or Firm*—Samuel M. Learned, Jr.

[57] ABSTRACT

A lifting tong link arm-to-tong arm toggle lock comprised of a rack and pinion sub-assembly member operably interposed to work angularly across one of the two symmetrical pivotally assembled scissor-acting upper link arm-to-lower tong arm junctures of a simple tong grab toggle structure, wherein the pinion wheel thereof is further provided with a ratchet wheel axially affixed thereto whereby the cooperatively activated release or engagement of a solenoid operated pawl with the ratchet tooth structure thereof respectively enables either opening of the tong for a grappling load engagement thereby or locking of the extended load suspending lifting tong structure when a load is grappled for movement thus providing a positive mechanical capability to prevent either an accidental or unintentional operator release of the load upon a load support surface after grapple displaced transport of a load from one location to another intermediate of and prior to accomplishing a final placement positioning deposit thereof.

5 Claims, 8 Drawing Figures

LIFTING TONG TOGGLE LOCK

BACKGROUND OF THE INVENTION

The instant invention relates to a lifting tong toggle lock adapted to be cooperatively employed in combination with a simple tong grab toggle structure that is provided with a tong latch for alternately holding the load engaging tong grapple members of the lifting tong structure in either an open position for purposes of accepting a load or releasing the lifting tong such that the pivotally assembled toggle arms thereof may thereupon symmetrically extend to pivotally close the tong arms for grappling engagement upon a load, wherein the teaching set forth by Heppenstall in U.S. Pat. No. 1,839,389 dated Jan. 5, 1932, is generally that type of a tong grab toggle structure with tong latch assembly upon which the instant invention may be employed in combination, although it is to be further understood that the instant invention may also be employed in combination with other types of simple tong grab toggle structures having a tong latch exemplary of which would be those as variously illustrated and taught in U.S. Pat. No. 1,506,827 to Gellert dated Sept. 2, 1924, with the understanding that by specific reference to the foregoing teachings the same are intended not to thereby be structurally restrictive of those specific types of simple tong grab toggles with tong latches with which the instant invention may be employed in combination, but exemplary only as are also to be regarded the representative renditions of such structures as herein illustrated.

Functionally, a simple tong grab structure as herein identified is operated to release a load engaged thereby by the operator thereof permitting the load to come to rest upon a support surface such as to cause a slackening of the tong suspending cable, as from an overhead crane or the like, both the tong like arms and tong arms of said grab structures symmetrically move downwardly thus pivotally opening the scissor-acting tong arm from engagement with the load and thereby releasing the load. In certain circumstances, however, as when attempting to jockey a tong suspended load into a confined position for storage stacking or the like, or when it is necessary to locate and position a vertically elongated tong suspended load, such as an ingot or the like, in a horizontally stacked configuration for storage or subsequent processing operations, one does not want the tong structure to collapse and thereby release the load upon an intermediate resting thereof upon a support surface prior to final positioning manipulation for load release, in which event either a floor tender is required to facilitate rehooking of the tong arm grabs to a load should the crane operator accidentally or inadvertently permit the tong structure to collapse during an intermediate support surface load resting stop, or some sort of mechanical lock assembly is necessary to maintain the loaded tong in an erected load carrying configuration irrespective of whether the load itself may be intermediately rested upon a support surface and until such time as the lock assembly is deliberately released whereby the tong structure is thereby enabled to collapse and disengage the load.

For purposes of labor economy and safety, employment of a mechanical tong lock assembly for maintaining the load is preferred to use of floor tender personnel, in which regard the following such devices, heretofore known, whereby tong grapple members may be locked in a particular position relative to the load to be carried, or carried thereby, said devices being as respectively taught in French Pat. No. 790,821 to Bertheaud dated Nov. 28, 1935, U.K. Pat. No. 709,438 to Davidson dated May 26, 1954, and U.S. Pat. No. 2,803,489 to Zito et al dated Aug. 20, 1957.

With respect to a rack and pinion structure having a ratchet wheel with cooperative locking and release pawl in combination therewith, Danish Pat. No. 25,407 to Riddersborg dated Dec. 22, 1919, teaches such a structure in a device employed to force open, and hold open, the abdominal body cavity of a slaughtered animal.

In French Pat. No. 1,230,272 to Boyer, dated Sept. 14, 1960, a rack and pinion crane clamp structure, activated to close and compressively engage and retain a load carried thereby upon elevation of the crane, is shown and taught.

Functionally, ratchet shaft grapple clamp locking and release means are as respectively shown and taught in U.S. Pat. No. 1,472,081 to Mercer dated Oct. 30, 1923, and U.S. Pat. No. 1,492,999 dated May 6, 1924, also to Mercer.

Some of the features of the instant invention have, in some respects, both structural and/or functional similarities to various of those teachings separately set forth in the prior art disclosures heretofore cited and briefly discussed. However, as will hereinafter be pointed out, the instant invention is distinguishable from said earlier inventions in one or more ways in that the present invention has utility features and new and useful advantages, applications, and improvements in the art of lifting tong toggle locking means not heretofore shown.

SUMMARY OF THE INVENTION

It is the principal object of the present invention to provide a lifting tong toggle lock means enabling a crane/tong operator positioned at an operator remote control location, singularly, to engage, lift, displace from one location to another, and position for release a tong suspended load whereby said lifting tong toggle lock provides a positive mechanical capability such as to prevent either an accidental or unintentional operator release of the load as a consequence of extended load bearing tong structure collapse during any intermediate load deposit upon a support surface prior to the operator accomplishing a final load placement positioning and tong toggle lock release deposit thereof.

It is another object of the present invention to provide a lifting tong toggle lock, the use of which eliminates any need or necessity for auxiliary floor tender personnel assistance during the accomplishment of tong grappled load displacement and positioning operations, such as in the event of an unintentional or accidental extended load bearing tong structure collapse and release during intermediary load deposit upon a support surface prior to final operator positioning and release thereof, thereby reducing both the labor cost factors and exposure of personnel to those hazardous conditions otherwise inherently present to tong grappled load displacement operations.

It is a further object of the present invention to provide a lifting tong toggle lock whereby the extended load bearing tong structure configuration may be positively maintained during and throughout horizontal placement operations in deposit positioning of an elongated vertically disposed load suspension such as with an ingot or the like.

Still another object of the present invention is to provide a lifting tong toggle lock adapted to be installed as original equipment in combination with a typical and simple tong grab toggle structure provided with a tong latch assembly, or alternately installed as an equipment modification means in combination therewith.

It is yet another object of the present invention to provide a lifting tong toggle lock which is mechanically simple and highly reliable in operation, safe and easily maintained, and capable of being operated by one not possessed of special skills or training.

Details of the foregoing objects and of the invention, as well as other objects thereof, are set forth in the following specification and illustrated in the accompanying drawings comprising a part thereof.

DETAILED DESCRIPTION OF THE INVENTION

Figure 1:
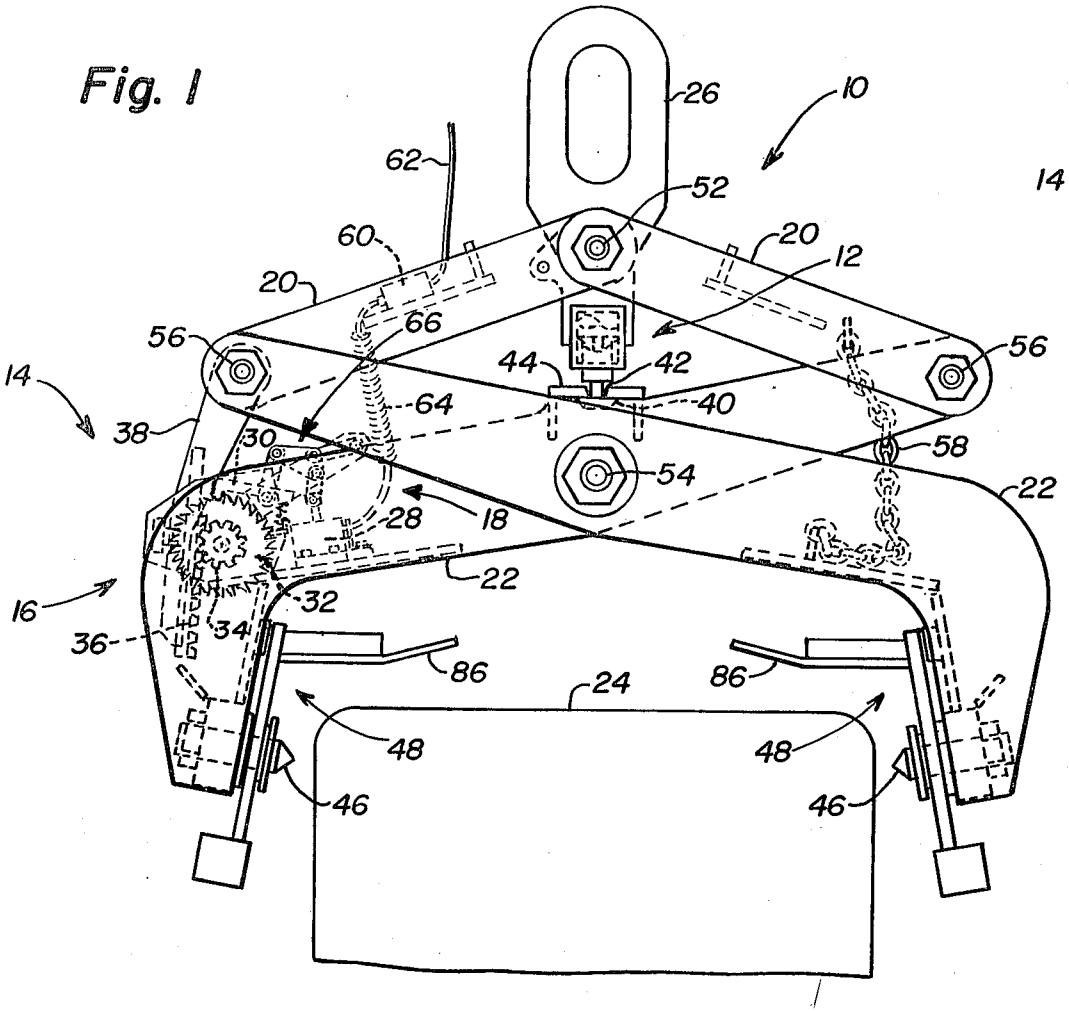
FIG. 1 is a side elevation of a simple lifting tong grab toggle structure provided with a typical tong latch and the lifting tong toggle lock hereof therewith in combination together comprising the instant invention, the same being shown in the tong-retracted operational configuration prepatory to grappling engagement thereby of a typical load.

Referring to FIG. 1, the present invention is shown which comprises in combination with a simple lifting tong grab toggle 10 provided with a tong latch 12, a lifting tong toggle lock 14 further comprised of a rack and pinion sub-assembly 16 mechanically cooperative with a pinion affixed ratchet wheel and solenoid operated pawl sub-assembly 18 operationally interactive to lock whereby the symmetrical pivotally assembled scissor-acting lifting tong grab toggle structure embodying both link arms 20 and tong arms 22 may be thereby maintained in an erected load supporting configuration throughout various load displacement and positioning manipulative operations as will hereinafter be more fully set forth and explained.

Referring again to FIG. 1 to describe in greater detail the component parts of this invention as well as explain the various operational techniques of employment thereof in accomplishing the tong engaged grapple movement of an exemplary load 24 from one location to another without the inconvenience of an unintentional, or hazard of an accidental, release of the load during intermediary handling operations prior to accomplishing a final placement positioning deposite thereof in either an upright or horizontal configuration, wherein the exemplary load 24, for purposes of illustration and continued explanation hereinafter is presumed to be an ingot.

Prior to actual load engagement use application, the lifting tong grab toggle 10, suspended from an overhead crane or the like by means of shackle 26, is contracted to the tong-retracted configuration as shown in FIG. 1 simply by allowing the tong scissor-acting structure to collapse under its own weight when deposited upon a support surface to cause a continual slackening of the tong-suspending cable or chain operable from said overhead crane or the like, being accomplished simultaneously in conjunction with a solenoid 28 activated pawl 30 disengagement from ratchet wheel 32 such that pinion 34 axially affixed thereto and meshed with the teeth of rack 36 is thereby unlocked and freed to rotate also thereby enabling said rack 36 to be driven by scissor-action retractive motion of tong structure 10 translated through communication therewith by means of pivotal connecting arm 38 (to be hereinafter more fully described during detailed consideration of subsequent Figures hereof), such that the tong latch 12 operates to respectively admit cooperatively therewith the elongated flanged head 40 thereof to, and cammably cycle the same into a right angle tong-retracted retention configuration engagement position with, the elongated slot 42 of the slotted tong latch retention plate 44 as shown to thereupon maintain until subsequent cam cycled load engaging release said lifting tong grap toggle 10 structure in the tong-retracted configuration with tong arms 22 thereof in the opened position.

In the above-described configuration said lifting tong grab toggle is made ready for positioning to engage a load such as an ingot 24, wherein the tong arms 22 thereof are respectively adapted for such service by being further provided with ingot engagement points 46 and toggle arm ingot engagement point positioning bracket assemblies 48 whereby point detents 50 (illustrated hereinafter in subsequent Figures hereof) are forceably punch-formed in said ingot 24 to thereby facilitate accomplishment of the handling and movement thereof by means of a lifting tong grab toggle 10.

Other structural components of the lifting tong grab toggle 10 assembly as illustrated in FIG. 1 include the shackle juncture pivot bolt 52 whereby the shackle 26 and upper ends of link arms 20 are pivotally joined, the tong arm juncture pivot bolt 54 whereby the respective tong arms 22 are pivotally joined intermediate the ends thereof, and link arm-to-tong arm pivot bolts 56 whereby the lower link arm ends are pivotally joined to the corresponding toggle structure of the upper tong arms ends, all of which pivotal assembly together and cooperatively provides generally the scissor-acting lifting tong grab toggle structure herein referred to. There is additionally provided a toggle extension limit chain 58 connectably communicating from one of the upper link arms 20 to the corresponding tong arm 22 therebelow whereby maximum tong extension is restricted by the lineal dimension of said limit chain 58 to thereby prevent inadvertent structural damage, and assembled to the opposite upper link arm 20 is a junction box 60 connecting a power transmission conduit line 62 with the solenoid 28 through coiled conduit 64 whereby said solenoid is activated and de-activated from a remote operator control location to initiate the pawl drive linkage 66 whereby locking and unlocking of the lifting tong toggle lock 14 is caused to be accomplished.

Figure 2:
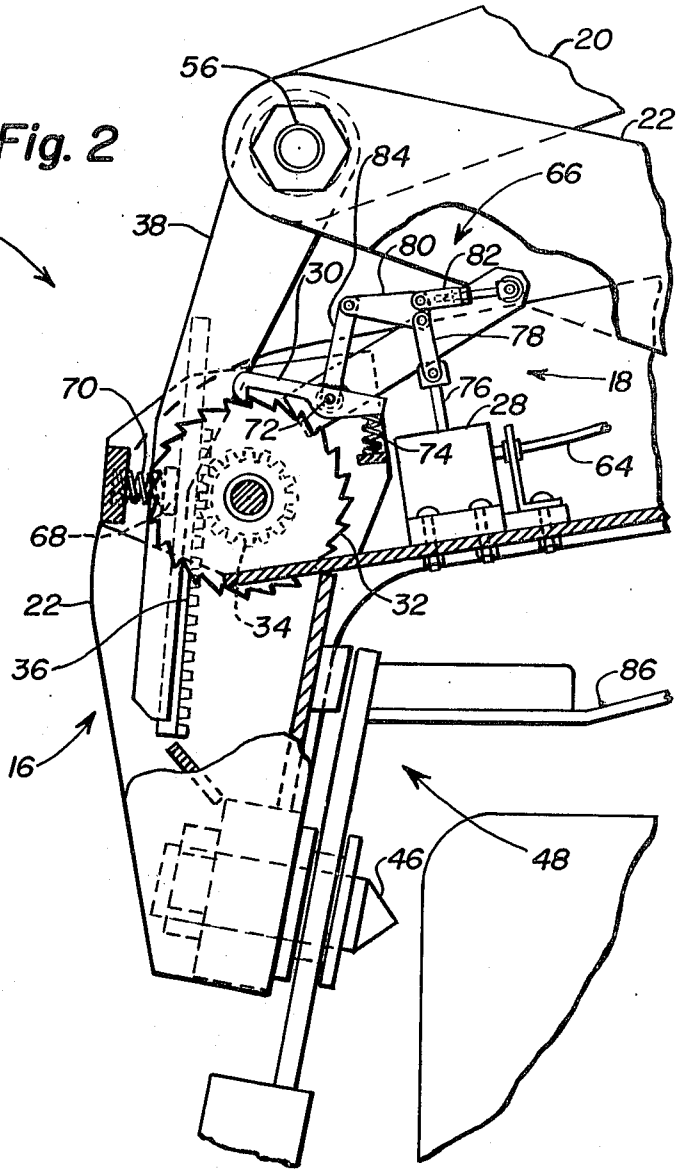
FIG. 2 is an enlarged side elevation of the lifting tong toggle lock assembly component of the instant inventive combination as shown in FIG. 1 wherein portions of the tong arm assemblies have been cut-away to more clearly illustrate the mechanically cooperative elements of said assembly when in the tong-retracted operational configuration.

Referring now to FIG. 2, which is an enlarged cutaway side elevation of the lifting tong toggle lock 14 as seen in FIG. 1, but showing greater structural detail thereof as to enable a continued description of the components and functional operations respectively thereof when configured in a tong-retracted attitude. As first seen therein, the rack 36, mounted in the pivotal connecting arm 38 so the teeth thereof mesh with the teeth of pinion 34 are maintained in meshed communication during scissor-acting pivotal connecting arm-to-rack translated extensive and retractive motion by means of the rack-rear compressive spring-loaded slide block 68 which continually operates under pressure of compressive spring 70 to cause such meshed communication throughout the range of said translated extensive and retractive motion.

Next shown in FIG. 2 is the pawl drive linkage 66 detail, wherein the pawl 30 is normally held in engaged contact with one of a plurality of tooth positions of ratchet wheel 32 as therein illustrated, pivotally about pawl mounting shaft 72 by compressive pressure of pawl spring 74 to thereby fix the lifting tong toggle lock 14 in the tong securing static position. It is upon solenoid powered activation of pawl drive linkage 66, through retraction of solenoid drive shaft 76 pivotally communicating such retractive motion through solenoid shaft link 78 to motion translating link 80 which is held in proper adjusted position by adjustment link 82 so as to thereby translate the solenoid drive shaft retractive motion through pawl link 84 against compressive force of pawl spring 74 to pivotally disengage the pawl 30 from being in contact with one of said plurality of ratchet wheel tooth positions, and thereupon release pinion 34 to thereupon also enable rotation thereof by rack translated extensive scissor-acting tong motion to achieve the erected load bearing configuration whereupon solenoid power deactivation said pawl 30, under the additive compressive pressure force of pawl spring 74, rotates about pawl mounting shaft 72 and returns to the normal tong securing static position of being held in engaged contact with one of said plurality of tooth positions of said ratchet wheel 32, that is, the lifting tong toggle lock 14 locked non-reversing position.

The lifting tong toggle lock 14 as herein disclosed and described is preferably constructed from metal, however, any other suitable materials or combinations thereof may be used.

Figure 3:
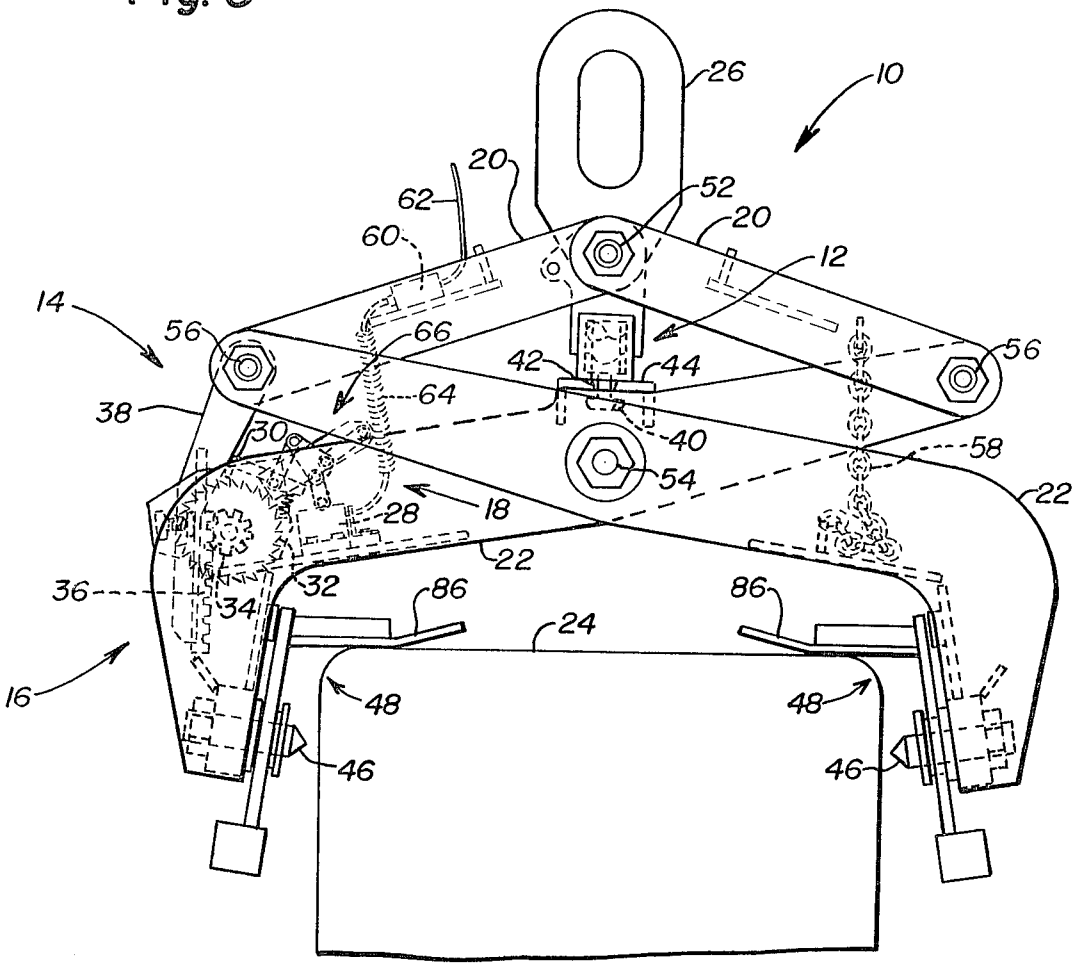
FIG. 3 is a side elevation of that combination together comprising the instant invention, the same being shown in the tong-released operational configuration and operationally positioned to accomplish grappling engagement of a typical load.

In FIG. 3 the lifting tong grab toggle 10 is shown placed in position upon an ingot 24 immediately prior to the tong grappling engagement use thereof, wherein the respective elevation positioning ingot engagement point guide plates 86 of the point positioning bracket assembly 48 resting on the top of ingot 24 are caused to support and bear the weight of said lifting tong grab toggle 10 structure which results in a slight collapse of said toggle 10 structure thereby resulting in a cammable indexing of the elongated flanged head 40 of the tong latch 12 to be on aligned positioning with the elongated slot 42 of the slotted tong latch retention plate 44 whereby said elongated flanged head 40 may clear for retraction through said elongated slot 42 upon extension of said tong 10 structure as the same is elevated by overhead crane means or the like to thereupon cause tong grab toggle 10 engagement with and elevation of ingot 24 to accomplish a location displacement movement thereof.

Figure 4:
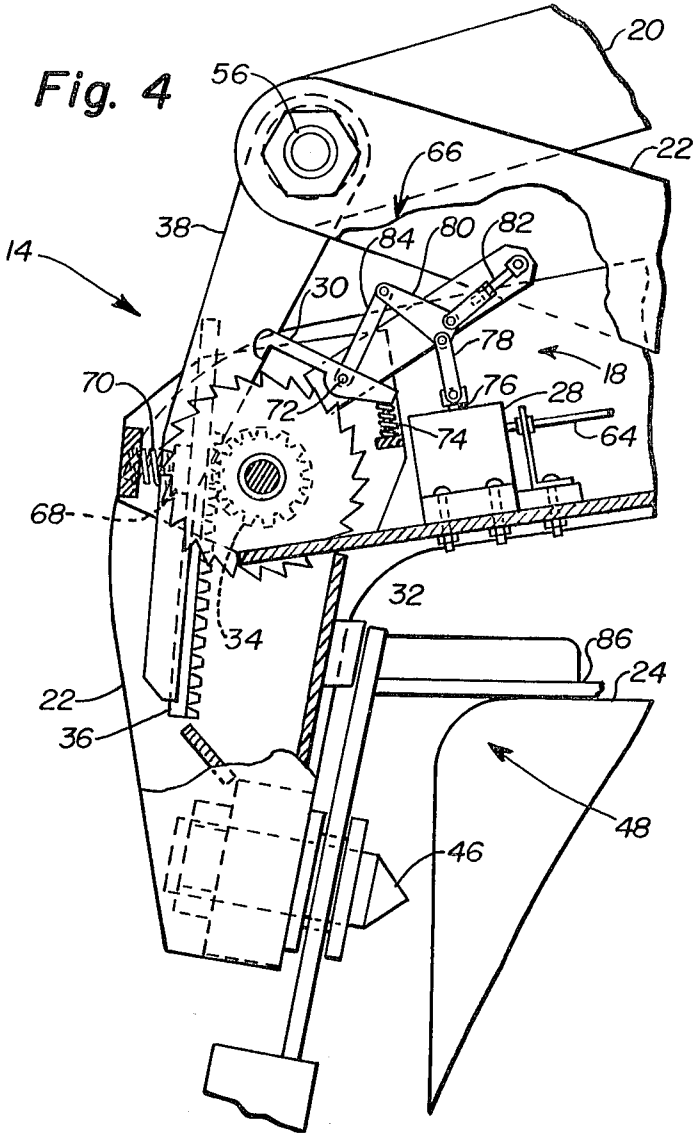
FIG. 4 is an enlarged side elevation of the lifting tong toggle lock assembly component of the instant inventive combination as shown in FIG. 3 wherein portions of the tong arm assemblies have been cut-away to more clearly illustrate the mechanically cooperative elements of said assembly when in the tong-released operational configuration.

Coincidentally with accomplishing the above tong positioning maneuver the crane/tong operator, from this remote control position, activates solenoid 28 by a remote control location switch means to communicate an impulse through power transmission conduit line 62/junction box 60/coiled conduit 64 and cause retraction of solenoid drive shaft 76 and further thereupon by means of pawl drive linkage 66 disengage pawl 30 from contact with one of said plurality of tooth positions of said ratchet wheel 32 whereby said lifting tong toggle lock 14 is readied to cooperatively enable tong 10 structure load engaging extension. Detail of the above-described ratchet wheel and solenoid operated pawl sub-assembly 18 is illustrated in FIG. 4, wherein is also shown more clearly the slight retractive motion effect of rack 36 resultant and transmitted upon a slight collapsing of said toggle 10 structure when positioned and set upon a load to be engaged to thereby accomplish cammable indexing for release of tong latch 12 assembly.

Figure 6:
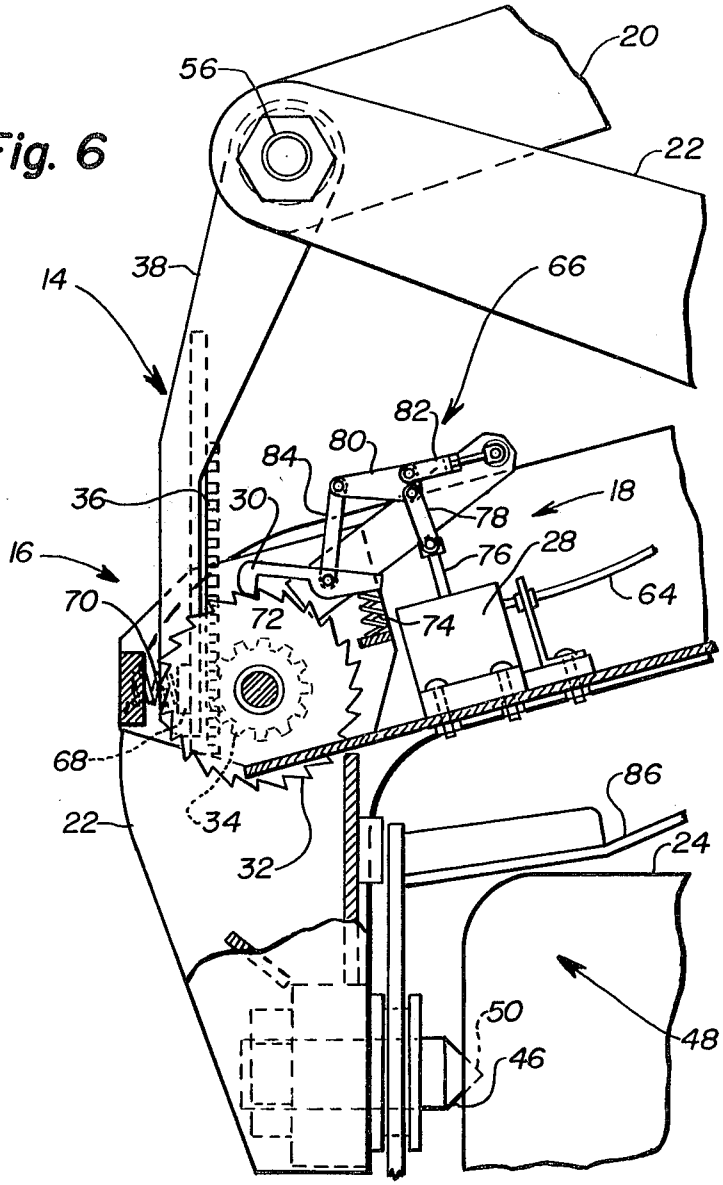
FIG. 6 is an enlarged side elevation of the lifting tong toggle lock assembly component of the instant inventive combination as shown in FIG. 5 wherein portions of the supporting tong arm assembly have been cut-away to more clearly illustrate the mechanically cooperative elements of said assembly when in the tong-extended operational configuration.
Figure 5:
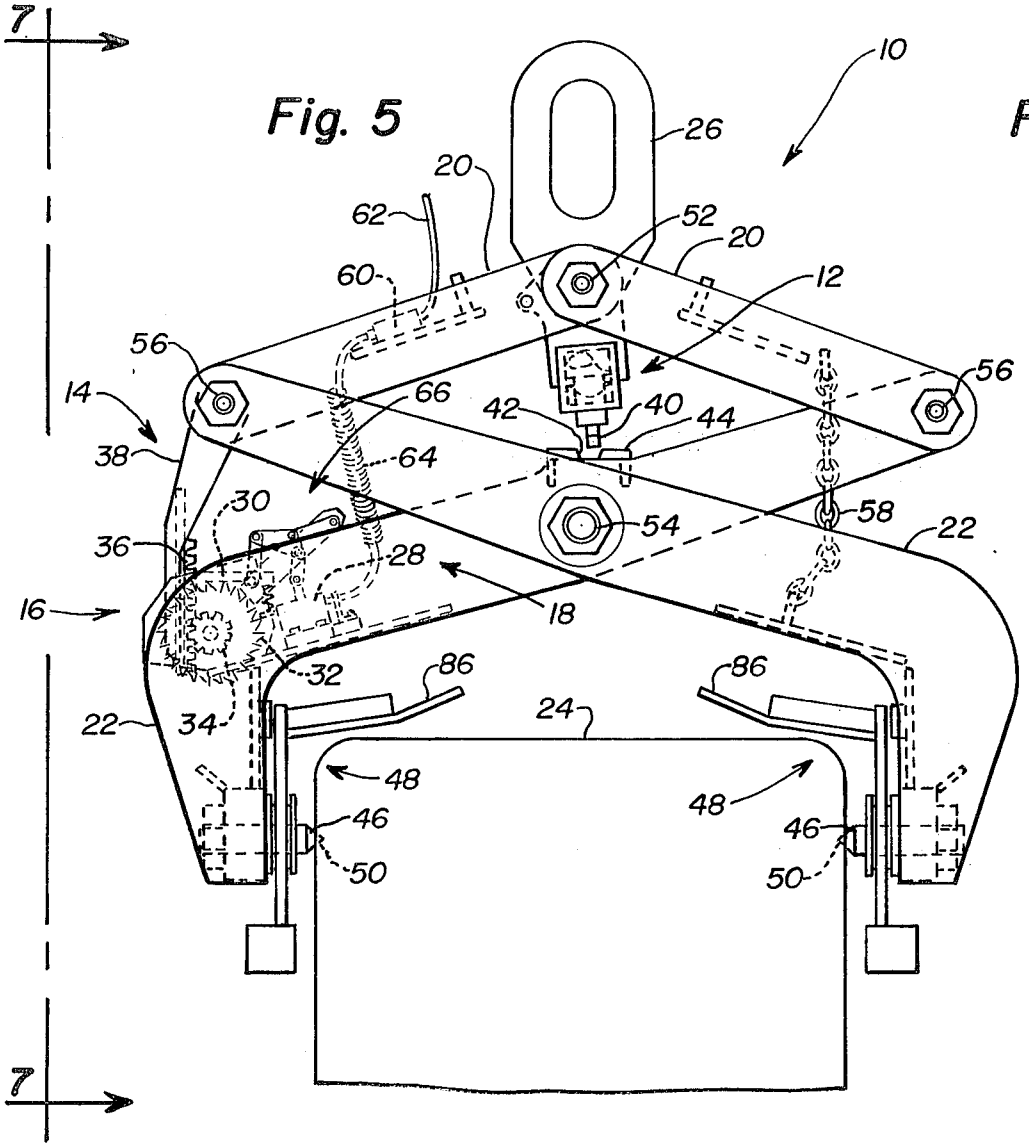
FIG. 5 is a side elevation of that combination together comprising the instant invention, the same being shown in the tong-extended load grappling and suspending operational configuration.
Figure 7:
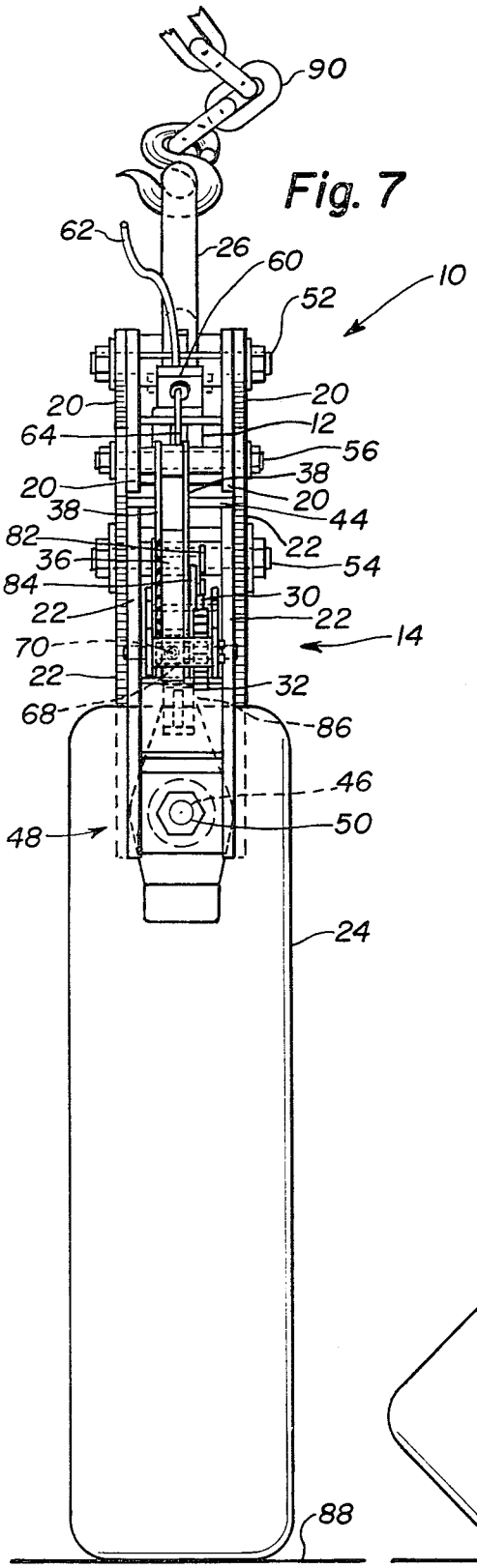
FIG. 7 is an end elevation of that combination together comprising the instant invention as seen along the line 7—7 of FIG. 5, with however, the load grappled thereby shown set upon an intermediary support surface and the lifting tong toggle lock configured as respectively illustrated in FIGS. 5 and 6 to thereby maintain the tong structure in an erected tong-extended load grappling operational configuration.
Figure 8:
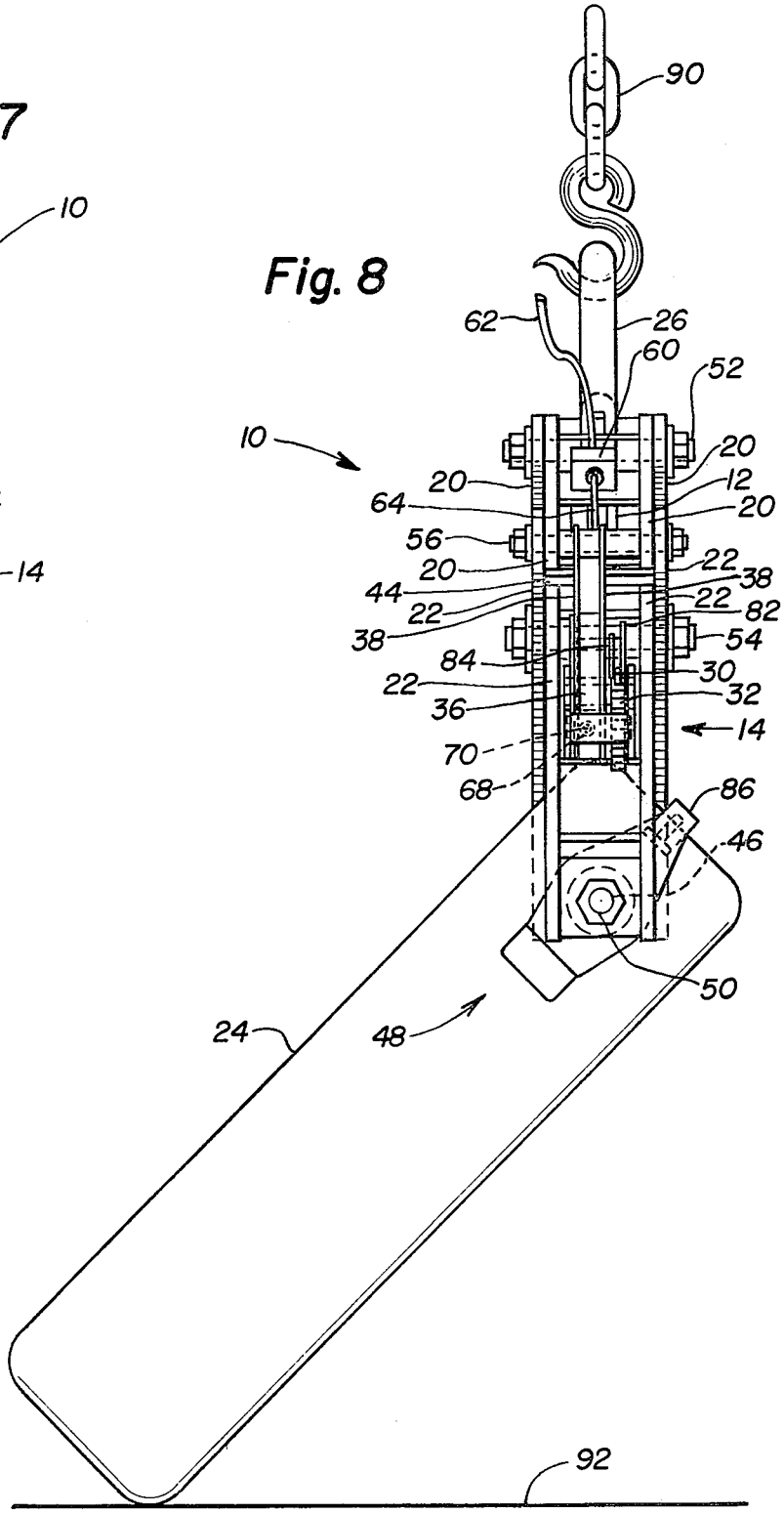
FIG. 8 is an end elevation of that combination together comprising the instant invention with the lifting tong toggle lock configured to maintain the tong structure in an erected tong-extended load grappling operational configuration to thereby hold the load during and throughout horizontal placement operations in deposit positioning thereof, with the load being herein shown set upon a support surface operationally intermediate the final horizontal placement position.

Referring now to FIG. 5, therein illustrating the tong 10 structure elevated into, and maintained in, a load 24 engaging erected configuration by the lifting tong toggle lock 14 of the instant invention, wherein the crane/tong operator, after engaging and elevating ingot 24 thereby resulting in the tong extended configuration also transmitting through pivotal connecting arm 38 a co-extensive motion to rack 36 translated to rotary motion by pinion 34 to drive ratchet wheel 32 axially affixed thereto, thereupon deactivated solenoid 28 to thereby cause pawl 30 engagement with one of a plurality of the teeth of ratchet wheel 32 and thereby lock pinion 34 axially affixed thereto, in turn locking said rack 36 whereby the tong 10 structure is fixed in the erected load bearing configuration as respectively hereinafter illustrated in FIGS. 7 and 8, that is, locked therein by said lifting tong toggle lock 14 until such time as the crane/tong operator reactivates solenoid 28 to disengage pawl 30 from the tooth structure of ratchet wheel 32. Detail of the lifting tong toggle lock 14 assembly configured in the tong lock configuration is illustrated in FIG. 6.

The view shown in FIG. 7 is an end elevation of the lifting tong grab toggle 10 structure in the erected load bearing configuration as maintained therein by lifting tong toggle lock 14 as previously described, when however, the load 24 is set upon an intermediary support surface 88 whereupon the crane-to-tong suspending chain 90 is allowed to slaken, notwithstanding which there is neither an inadvertent or accidental release of the load 24 as the lifting tong toggle lock 14, when engaged on rack 36 extension, prevents collapse of the erected tong 10 structure.

Considering lastly the view shown in FIG. 8, therein illustrating use of lifting tong grab toggle 10 in a horizontal load positioning application with the erected load bearing structure thereof maintained by employment of said lifting tong toggle lock 14 to thereby control final placement positioning of an ingot 24 upon a storage location support surface 92.

Although the invention has been herein shown an described in what is conceived to be the most practical and preferred embodiment, it is recognized that departures may be made therefrom within the scope of the invention, which is not to be limited to the details disclosed herein but is to be accorded the full scope of the claims so as to embrace any and all equivalent devices and apparatus.

I claim:

1. A lifting tong toggle lock adapted for installation and use upon a simple tong grab toggle structure provided with a tong latch and operable to maintain said tong grab toggle structure in an erected load bearing configuration upon tong engagement and subsequent intermediate handling of a load during removal and relocation deposit positioning thereof, said lifting tong toggle lock comprising in combination:

(a) an angularly dependent connecting arm pivotally assembled at the upper end thereof to a link arm-to-tong arm scissor-acting juncture of said tong grab toggle structure and at the lower end thereof adapted to support an elongated rack member provided with a longitudinal plurality of gear teeth disposed along the tong-inwardly facing surface thereof, (b) a gear-toothed pinion rotationally assembled to a tong arm of said tong grab toggle structure downwardly of said link arm-to-tong arm scissor-acting juncture thereof, said gear-toothed pinion adapted to receive in meshed communication the tong-inwardly facing longitudinal plurality of said elongated rack member gear teeth for transmission thereto of either extensive or retractive scissor-acting motion of said tong grab toggle structure, (c) a non-reversing means provided with a radially disposed plurality of circumferential teeth and assembled on axial alignment one side of said gear toothed pinion to be communicatively rotational therewith, (d) a pawl pivotally adapted through a drive linkage for solenoid powered engagement and disengagement with at least one of said non-reversing means radially disposed plurality of circumferential teeth to thereby, upon pinion-transmitted extensive scissor-acting tong structure erecting motion thereto, fix said tong grab toggle structure in a locked load bearing erected configuration, and (e) a solenoid to power said drive linkage whereby said pawl is caused to pivotally fix and un-fix said tong grab toggle structure to and from the locked load bearing erected configuration.

2. The lifting tong toggle lock according to claim 1 in which said non-reversing means is a ratchet wheel.

3. The lifting tong toggle lock according to claim 1 in which the longitudinal plurality of gear teeth of said elongated rack member are maintained in close meshed communication with said gear-toothed pinion by means of a rack tooth rear compressive spring-loaded slide block.

4. The lifting tong toggle lock according to claim 1 in which said drive linkage is provided with an adjustment link.

5. The lifting tong toggle lock according to claim 1 in which the tong grab toggle structure in combination therewith is provided with a toggle extension limit chain whereby maximum tong extension is restricted to thereby prevent inadvertent structural damage to said lifting tong toggle lock.

* * * * *